US008092620B2

(12) United States Patent
Sadhukhan et al.

(10) Patent No.: US 8,092,620 B2
(45) Date of Patent: Jan. 10, 2012

(54) HIGH STRENGTH AUSTENITIC TRIP STEEL

(75) Inventors: Padmanava Sadhukhan, Hillsboro, OR (US); Gregory B. Olson, Riverwoods, IL (US)

(73) Assignee: Northwestern University, Evanston, IL (US)

( * ) Notice: Subject to any disclaimer, the term of this patent is extended or adjusted under 35 U.S.C. 154(b) by 0 days.

(21) Appl. No.: 12/460,508

(22) Filed: Jul. 20, 2009

(65) Prior Publication Data

US 2010/0143181 A1 Jun. 10, 2010

Related U.S. Application Data

(60) Provisional application No. 61/135,334, filed on Jul. 18, 2009.

(51) Int. Cl.
*C22C 38/00* (2006.01)

(52) U.S. Cl. ..... 148/328; 148/325; 420/96

(58) Field of Classification Search ..... 148/328, 148/335; 420/96

See application file for complete search history.

(56) References Cited

U.S. PATENT DOCUMENTS 4,619,699 A * 10/1986 Petkovic-Luton et al. ..... 75/252

FOREIGN PATENT DOCUMENTS

JP 2006089796 * 4/2006

OTHER PUBLICATIONS

G.B. Olson, et al., Stress-Assisted Isothermal mertensitic transformation: Application to TRIP steels, Met. Trans., 1982, vol. 13A, pp. 1907-1914.

G.B. Olson, et al., A General Mechanism of Martensitic Nuleation: Part II. FCC → BCC and other Martensitic Transformations, Met. Trans., 1976, vol. 7A, p. 1905-1914.

G. Kohn, Effects of TRIP phenomenon on the toughness of Heat Treatable Alloy Steels, Doctoral Thesis, University of California, Berkeley, 1976.

D. Bhandarkar, et al., Stability and Mechanical Properties of Some Metastable Austentic Steels, Metall. Trans., 1972, vol. 3, pp. 2619-2631.

A. Saha, Systems Design of Ultra-tough High Strength Steels for blast-Resistant Naval Hull Application, Doctoral Thesis, 2004, Northwestern University.

R.H. Richman, et al., Stress, Deformation and Martensitic Transformation, Met. Trans., Sep. 1971, vol. 2, 2451-2462.

G. Ghosh, et al., Kinetics of FCC → BCC Heterogeneous Martensitic Nucleation- I. The Critical Driving Force for Athermal Nucleation, Acta. Mater., 1994, 42, pp. 3361-3371.

G. Ghosh, et al., Kinetics of FCC → BCC Heterogeneous Martensitic Nucleation-II. Thermal Activiation, Acta. Mater. 1994, 42, pp. 3371-3379.

A. Saha, et al., Prototype evaluation of transformation toughened blast resistant naval hull steels: Part II, J Computer-Aided Mater. Des. 2007, 14, pp. 201-233.

* cited by examiner

*Primary Examiner* — Sikyin Ip

(57) ABSTRACT

An austenitic TRIP steel consisting essentially of, in weight %, 0.14 to 0.18% Al, 2.8 to 3.2% Ti, 23.5 to 23.8% Ni, 3.8 to 4.2% Cr, 1.1 to 1.3% Mo, 0.29 to 0.31% V, 0.01 to 0.015% B, 0.01 to 0.02% C, and balance Fe and incidental impurities exhibits combined high yield strength and high strain hardening leading to improved stretch ductility under both tension and shear dynamic loading conditions.

10 Claims, 4 Drawing Sheets

| | BA120 (wt%) | | |
|---|---|---|---|
| Components | Designed | LEAP (Solution Treated) | Spectroscopy (EAG) |
| Fe | 67.82 | 68.28 ± 0.15 | 68.29 |
| Al | 0.16 ± 0.021 | 0.152 ± 0.013 | 0.15 |
| Ti | 3.00 ± 0.22 | 2.90 ± 0.24 | 2.97 |
| Ni | 23.50 ± 0.11 | 23.0 ± 0.07 | 23.00 |
| Cr | 4.00 ± 0.20 | 4.11 ± 0.11 | 4.08 |
| Mo | 1.20 ± 0.12 | 1.18 ± 0.12 | 1.20 |
| V | 0.30 ± 0.011 | 0.30 ± 0.04 | 0.29 |
| B | 0.0125 ± 0.0.002 | - | 0.0046 |
| C | 0.01 (+ 0.01) | - | 0.0082 |
| N | 0.001 (+ 0.003) | - | < 0.001 |
| O | - | - | 0.0017 |
| S | - | - | 0.0032 |

Figure 1

First impulse.

Second impulse.

HIGH STRENGTH AUSTENITIC TRIP STEEL

This application claims benefits and priority of provisional application Ser. No. 61/135,334 filed Jul. 18, 2009, the entire disclosure of which is incorporated herein by reference.

CONTRACTUAL ORIGIN OF THE INVENTION

This invention was made with government support under Grant No. N00014-01-1-0953 awarded by the office of Naval Research. The Government has certain rights in the invention.

FIELD OF THE INVENTION

The present invention relates to high strength austenitic TRIP (transformation-induced plasticity) steels having improved mechanical properties.

BACKGROUND OF THE INVENTION

Recent assessment of material property requirements for blast resistant applications, especially for the naval ship hulls, has defined the need to design steels with high stretch ductility and fragment penetration resistance, along with high strength and adequate toughness. Advancement in new systems-based design methodology which accelerates the total product development life-cycle while achieving new levels of product reliability has led to rapid innovations in steel technology and design. In an effort to create materials with maximum durability for varied applications ranging from hull steels for Naval warships, aircraft landing gears to high performance engines, most of recent steel research initiatives have mainly focused on achieving extremely high strength or toughness or combinations of both accompanied with good weldability and corrosion resistance. However, in the wake of current needs of the Navy in specific where high blast impulse resistance coupled with fragmentation/shear resistance is desired for any new alloy design, it has been recognized that an ideal performance criterion in addition to high strength would be to have high uniform ductility under both tension and shear loads.

The particular challenge of the current design problem is to achieve both strength and fracture toughness while maintaining high uniform ductility and shear resistance at room temperature; usually with the gain of one comes the loss of the other. The use of austenitic Transformation-Induced Plasticity (TRIP) steels designed earlier [reference 1] allows plastic flow stabilization that can be applied to either uniform ductility or toughness. This austenite to martensite transformation is influenced by temperature, applied stress, composition of the alloy, strain-rate, stress-state and any prior deformation of parent austenite [reference 2]. The mechanism of the transformation and the kinetics governing it have been well established by Olson and Cohen [references 3-5] and have been used to generate constitutive equations and models to determine the stability of the parent matrix phase, which is critical in determining ideal transformation temperature and other parameters. The transformation to martensite provides resistance to necking in tension thereby increasing not only the uniform ductility but also the ultimate tensile strength (UTS) [reference 6]. This transformation behavior is dependent on the stability of the austenite matrix and its influence on the mechanical properties of TRIP steels have been extensively studied by Bhandarkar et al. [reference 7].

While the martensitic BlastAlloy160 [reference 8] steel was designed based on the initial assumption that toughness is the critical factor in blast protection, recent computer simulations and failure analysis [reference 9] have indicated that uniform ductility is the limiting property for impulse resistance, provided a critical toughness is maintained to avoid shattering. This reassessment of requirements has changed the goals of the current design to develop a prototype which has improved ductility at high yield stress levels with just sufficient fracture toughness. These objectives should be met while maintaining the other properties desirable for naval hull steels, such as non-ferromagnetism (for reduced magnetic signature at use temperatures), good weldability, and resistance to hydrogen-stress-corrosion cracking. Based on these requirements, the following property objectives have been defined:

1. To achieve Yield Strength of ~120 ksi and UTS >130 ksi.
2. To achieve at least 20% uniform elongation under tension and shear loading conditions at room temperature, with significant necking (>50% in Reduction of Area)
3. To maintain a high fracture toughness (greater than 90 ksi/in0.5)—since a goal of this invention is improved ductility, the fracture toughness requirements have been lowered.
4. To be non-magnetic at use temperatures—the invention will constrain the Curie temperature, $T_c$ of the alloy composition below room temperature.
5. To be easily weldable
6. To be resistant to environmental hydrogen and stress-corrosion cracking
7. Low Cost Most of the commercially available steels used to build hulls of ships, such as the A286 and HSLA 100 steels, have an inadequate combination of strength-toughness—ductility properties. An increase in one of these properties leads to the decrease in the other and combined with other material characteristics, such as weldability and low cost, these alloy steels do not serve the necessary objective of adequate resistance against blast impulse explosions and fragments.

SUMMARY OF THE INVENTION

The present invention provides an austenitic TRIP steel consisting essentially of, in weight %, 0.14 to 0.18% Al, 2.8 to 3.2% Ti, 23.5 to 23.8% Ni, 3.8 to 4.2% Cr, 1.1 to 1.3% Mo, 0.29 to 0.31% V, 0.01 to 0.015% B (100 to 150 ppm B), 0.01 to 0.02% C, and balance Fe and incidental impurities. The austenitic TRIP steel exhibits combined high yield strength and high strain hardening leading to improved uniform ductility under both tension and shear dynamic loading conditions. The austenitic TRIP steel exhibits a relatively high uniaxial tension $M_s^{\sigma}$ temperature after aging to the desired strength level such that unique and beneficial high ductility in tension and shear, particularly under high strain-rate adiabatic blast conditions, are provided under room or ambient temperature conditions.

These and other advantages of the present invention will become more readily apparent from the following detailed description taken with the following drawings.

BRIEF DESCRIPTION OF THE DRAWINGS

FIG. 1 is a table showing desired and measured composition of alloy BA 120 steel according to an illustrative embodiment of the invention.

DETAILED DESCRIPTION OF THE INVENTION

Figure 2:
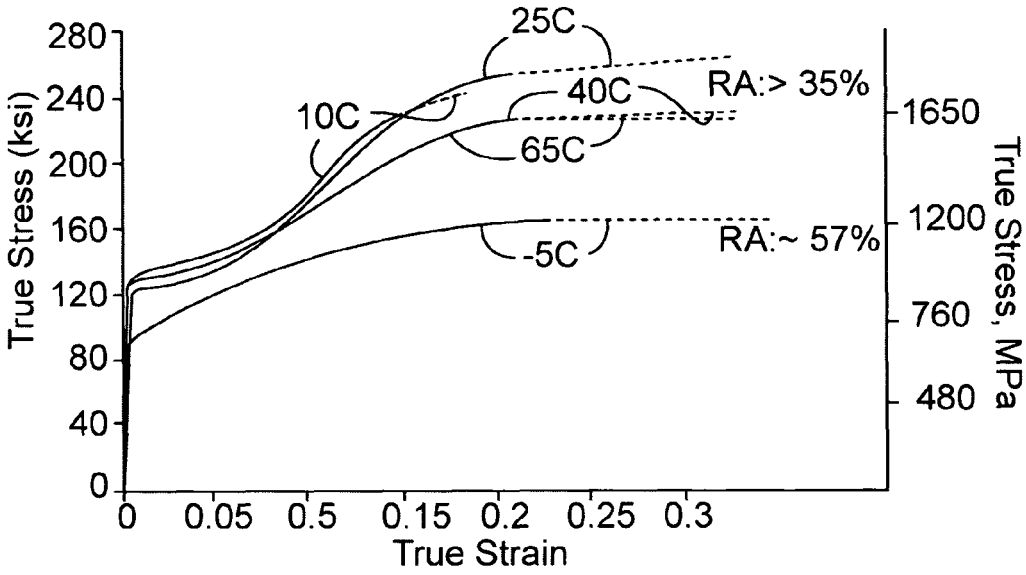
FIG. 2 is a plot showing a comparison of the true stress-strain uniaxial tensile data for alloy BA120 steel wherein specimens were solutioned at 950 degrees C., cooled by oil quench, and aged at 750 degrees C. for 10 hours. The test temperature is indicated in bold across each curve. The solid curves indicate the elastic range and the dotted lines show the plastic strain until the point of fracture, thereby indicating final fracture strain.

Alloy Design:

The invention provides an improved austenitic TRIP steel by using a systems engineering framework embodying precipitation strengthening and matrix stability thermodynamic design models to meet the desired property objectives for a blast resistant austenitic TRIP steel. The austenitic TRIP steel of the invention thus employs a combination of γ'-phase (gamma prime phase) precipitation strengthening together with transformation induced plasticity leading to austenite matrix stablity to provide improved mechanical properties compared to currently used steels for blast protection applications. For example, the yield strength requirements of the steel can be met by the precipitation of γ'-intermetallic $Ni_3$(Ti,Al) phase (gamma prime phase) in the austenitic matrix (γ matrix). The austenite matrix contributes about 49 ksi (338 MPa) of the required strength and the remainder is contributed by appropriate mole fraction of γ'-phase precipitation in the austenitic matrix. Al and Ti contents of the alloy are varied to achieve the amount of γ'-phase precipitation needed, while maintaining a constant ratio of Al/Ti in the alloy. Proper heat treatment steps are employed for the alloys based on required phase fraction of γ'-phase at equilibrium with the austenite matrix.

By relating the stress-assisted martensitic transformation to the critical transformation temperature ($M_s^o$) corresponding to uniaxial tension, the stability of the austenite phase was defined through a set of quantitative models. $M_s^o$ refers to the maximum temperature at which an applied elastic stress causes martensitic transformation and was coined by Richman et al. in "Stress, Deformation and Martensitic Transformation", Met. Trans. 2, (1971) September pp. 2451-2462, which is incorporated herein by reference. So, at the $M_s^o$ temperature, if a stress equal to the yield stress is applied, the austenite transforms. Below the $M_s^o$ temperature, stress-assisted martensitic transformation occurs, and above the $M_s^o$ temperature, strain-induced martensitic transformation takes place. The morphology of the marteniste is different for stress-assisted transformation where marteniste plates are produced, as compared to strain-induced transformation, where finer marteniste forms at shear bands.

The critical value of the Austenite Stability Parameter (ASP) at the $M_s^o$ temperature is defined as the sum of the mechanical driving force of transformation ($\Delta G^o$) and a constant critical free energy term ($g_n$) [see G. B. Olson and M. Cohen: Met. Trans. A, vol. 7A, 1976, pp. 1915, which is incorporated herein by reference]. The ASP term is then equated to the composition and temperature dependence of the frictional work of martensitic interface motion and the change in Gibb's free energy associated with the FCC→BCC martensitic transformation. Transformation-induced plasticity (TRIP) is employed together with γ'-phase (gamma prime phase) precipitation strengthening to achieve the desired mechanical properties in the alloy steels of the invention. The design $M_s^o$ temperature corresponding to uniaxial tension of the alloy was set according to the optimum performance (maximum uniform ductility). Ni and Cr contents of the alloy were varied to determine their optimum concentrations so as to meet the necessary ASP requirements at the pre-determined critical $M_s^o$ temperature. The design revealed that Ni has a very strong effect on the matrix stability in austenitic TRIP steels. A relatively low Cr content and relatively high Ni content are employed. Carbon content is controlled by the amount of the fine grain refining FCC dispersion phase TiC desired in the alloy. The presence of about 0.15 atomic % TiC in the matrix during solution treatment is enough for this purpose, which leads to a carbon content set forth below. Boron is included in the alloy to enhance grain-boundary cohesion (cohesion of austenitic grain boundaries) in order to reduce the occurrence of intergranular fracture. However, Mn was not intentionally included in the alloy composition since it is known to reduce uniform ductility in TRIP steels. The alloy thus is free of intentional Mn addition. Other elements such as Mo and V are provided in the ranges set forth below.

In particular, in accordance with an embodiment of the invention, an austenitic TRIP steel is provided consisting essentially of, in weight %, 0.14 to 0.18% Al, 2.8 to 3.2% Ti, 23.5 to 23.8% Ni, 3.8 to 4.2% Cr, 1.1 to 1.3% Mo, 0.29 to 0.31% V, 0.01 to 0.015% B (100 to 150 ppm B), 0.01 to 0.02% C, 0.1% maximum Mn, 0.1% maximum Si, 0.01% maximum Cu, 0.01% maximum P, 0.004% maximum S, and balance Fe and incidental impurities, which typically can include N and O. The austenitic TRIP steel can be subjected to a solutioning temperature and time of 950° C. for 1 hr, cooling by oil quench to room temperature followed by an aging (precipitation) heat treatment at 750 degrees C. for 10 hours to obtain peak hardness, although practice of the invention is not limited to these heat treatment parameters. The austenitic TRIP steel exhibits a relatively high uniaxial tension $M_s^o$ temperature after aging to the desired strength. This ensures high ductility in tension and shear (particularly under high strain-rate adiabatic blast conditions) under ambient temperature conditions to achieve unique mechanical performance. For purposes of illustration and not limitation, the uniaxial tension $M_s^o$ temperature after aging to the desired strength can be within 20 degrees C. of ambient or room temperature, such as an $M_s^o$ of about 5 degrees C. to about 40 degrees C. The steel in accordance with the invention demonstrates that enhanced ductility under high strain-rate adiabatic conditions can be achieved.

FIG. 1 shows the nominal composition (desired and measured) for alloy BA120 which is a non-stainless austenitic steel optimized for adequate blast protection by having high strength and high ductility in accordance with an illustrative embodiment of the invention. For alloy BA120, the calculated values of gamma prime phase fraction at equilibrium at 750 degrees C. and their ASP values for critical transformation of 5 degrees C. for tensile ductility are 0.083 gamma prime mole fraction, calculated ASP of −507 J/mol and desired ASP of −508 J/mol.

An even more refined calculated desired nominal composition for alloy BA120 consists essentially of, in weight %, 0.163% Al, 3.029% Ti, 23.542% Ni, 3.986% Cr, 1.245% Mo, 0.319% V, 0.0125% B, 0.01% C, and balance Fe and incidental impurities.

Evaluation of the alloy BA120 confirmed the simultaneous improvement in uniform ductility under tensile and shear loading in this austenitic TRIP steel. In particular, the alloy BA120 was melted and forged and specimens of the alloy were used for mechanical tests as well as being subjected to microscopic and surface analysis techniques. A 300 pound heat of 8" diameter ingots was prepared by multiple melting techniques using vacuum induction melting (VIM) of raw virgin materials followed by vacuum arc remelting (VAR), with strict control over composition. The ingots were homogenized at 1190 degrees C. (2175 degrees F.) for 24 hours. The temperatures were held within plus or minus 1 hour followed by air cooling. Break down forging was conducted at temperatures below 1093 degrees C. (2000 degrees F.). Forging at the homogenization temperature is allowed but additional heating was done at a maximum temperature of 1093 degrees C. (2000 degrees F.). Forging of sizes smaller than 4.5 inch by 4.5 inch square (114 mm×114 mm square) was conducted at temperatures below 1038 degrees C. (1900 degrees F.). No forging was allowed below 927 degrees C. (1700 degrees F.).

Surface microscopy and Vickers Microhardness measurements were done on austenized as well as aged specimens of the homogenized alloy BA120. A surface microhardness of 317 VHN (leading to an expected 124 ksi YS) was measured for BA120 specimens aged at 750° C. for 10 hours. Microhardness measurements were also taken for aged specimens at various times to determine the variation of hardness with temper time. Isochronal tempering study confirmed that the peak hardness (leading to maximum yield stress) occurs at 10 hours of aging time, at the standard temperature of 750° C.

Mechanical testing and nano-scale characterization of these specimens confirmed improvements in yield strength as well as uniform ductility at room temperature due to transformation strain hardening, leading to higher uniform ductility under tension as well as shear/torsion loading. The performance has been compared to the currently used steel for blast resistant applications such as HSLA 100 alloy steel and significant improvements have been shown for the alloy BA120.

Figure 3:
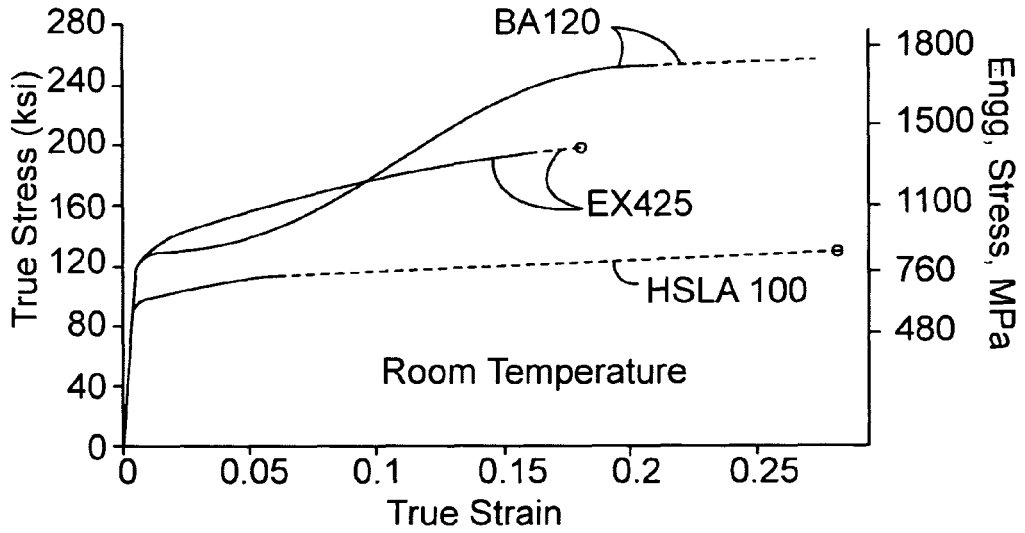
FIG. 3 is a plot showing a comparison of true stress-strain uniaxial tensile tests at room temperature for alloy BA120 and HSLA 100 steel and a comparison experimental alloy EX425.
Figure 4:
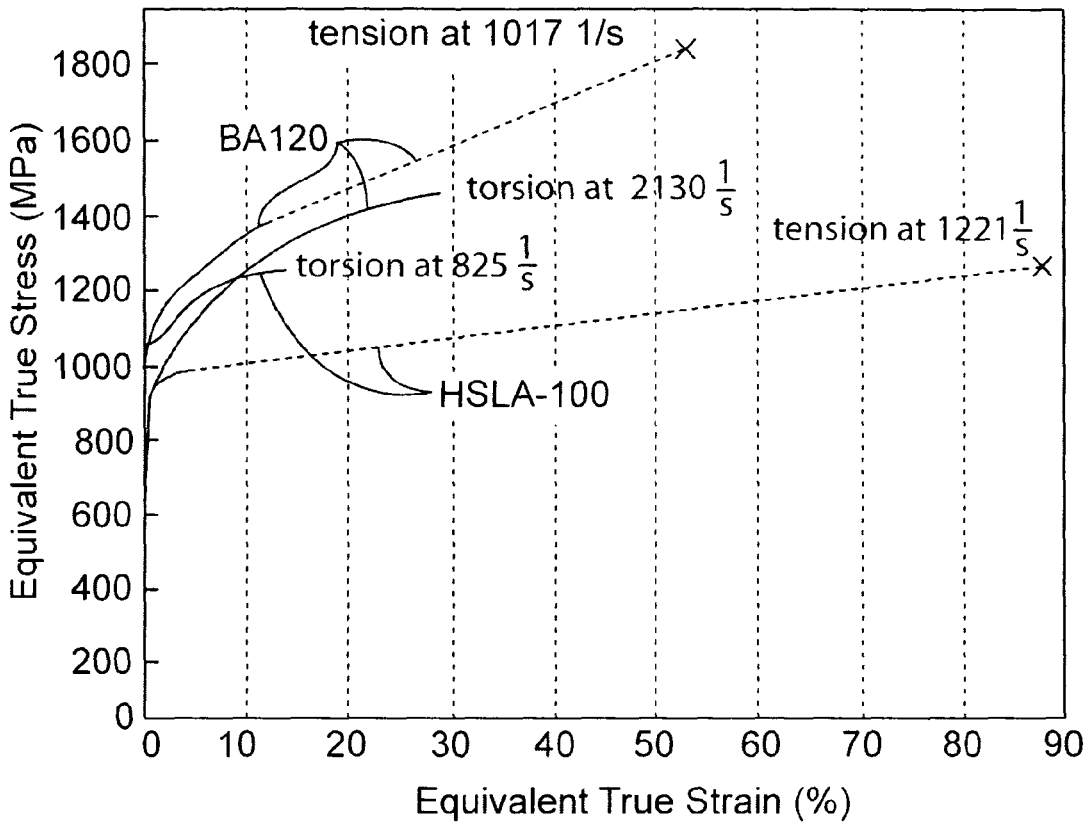
FIG. 4 is a plot showing a comparison of true stress-strain curves for dynamic tensile and torsion/shear tests at room temperature for BA120 and HSLA 100 steel and a comparison experimental alloy EX425.

The characterization of the low-chromium alloy BA120 thus yielded encouraging results. Static as well as dynamic tensile tests confirmed high strength and high ductility due to the occurrence of strain hardening at room temperature. The principle design objective was to attain the combination of high strength and high ductility at room temperature under tensile loading. The room temperature tensile yield stress for alloy BA120 was measured to be approximately 124-127 ksi (855-875 MPa). The measured yield stress under dynamic tensile and shear loading were 150-152 ksi (1049 MPa) and 160 ksi (1100 MPa). High strain hardening was confirmed leading to UTS of 246 ksi (1696 MPa) under quasi-static loading and a UTS of about 195 ksi (1344 MPa) under dynamic loading. These values are much higher than HSLA 100 steel. The uniform ductility under uniaxial tension for alloy BA120 is 21% with a fracture strain of 37% as compared to 16% uniform ductility and approximately 17% fracture strain for a comparison experimental alloy EX425 having a composition, in weight %, of 25.04% Ni-3.93% Cr-2.97% Ti-1.25% Mo-0.16% Al-0.32% V-0.09% Mn-0.005% C-0.0093% B-balance Fe. Fracture strain improved by as much as 100% over the comparison experimental alloy EX425. The equivalent shear yield stress measured is approximately 135 ksi (930 MPa), under dynamic shear loading. The measured uniform shear strain for BA120 is approximately 53% with the equivalent strain being approximately 30%. The shear strain and strain hardening is much higher than observed for HSLA100 steel. Thus, the alloy BA120 demonstrates the feasibility of combining γ' phase-precipitation strengthening along with transformation plasticity leading to optimum austenite matrix stability in the design an austenitic TRIP steel with improved mechanical properties over the currently used austenitic steels for blast protection applications. Moreover, alloy BA120 has a measured uniaxial tension $M_s^{\sigma}$ temperature (corresponding to uniaxial tension) of about 36 degrees C. after aging to the desired strength level. FIGS. 2-4 represent the various tension and torsion test results for the alloy BA120 for both static as well as dynamic loading conditions. FIG. 2 represents the temperature dependence of the stress for alloy BA120 showing high strain hardening at the desired operating room temperature. FIG. 3 shows the direct comparison of the tensile test results at room temperature for alloy BA 120, comparison experimental alloy EX425, and HSLA 100 and demonstrates the improvement of the properties for BA120 for blast protection applications as compared to the others. FIG. 4 shows the much improved performance of the alloy BA120 under dynamic torsion loading which is important for fragment resistance of the materials. The results from the dynamic shear tests have shown that alloy BA120 has very good fragment protection properties. The fluid-structure interaction (FSI) ballistic test results have also shown that underwater dynamic impact of blast leads to a very high strain (improvement of over 40% with respect to the AISI 1018 monolithic plate) in alloy BA120 without fracture at higher multiple impulses, leading to improved blast-protection application especially for naval applications.

Figure 5A:
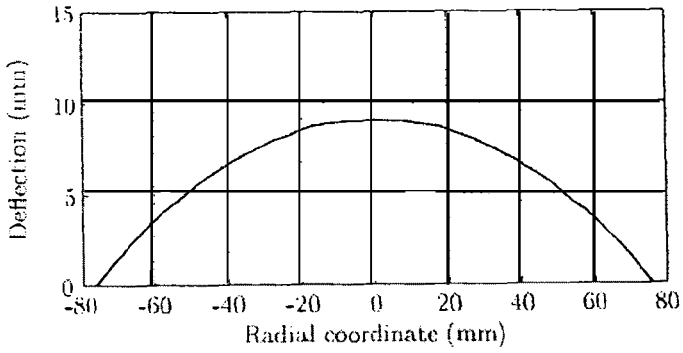
FIG. 5*a* is a deflection profile obtained for the BA120 steel post FSI-ballistic tests on subsequent impulses showing deflection profile post first impulse.
Figure 5B:
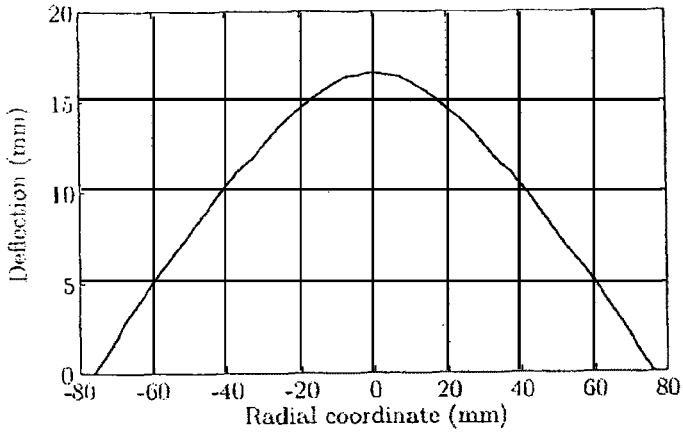
FIG. 5*b* is a deflection profile obtained for the BA 120 steel post FSI-ballistic tests on subsequent impulses showing deflection profile post second impulse.
Figure 5C:
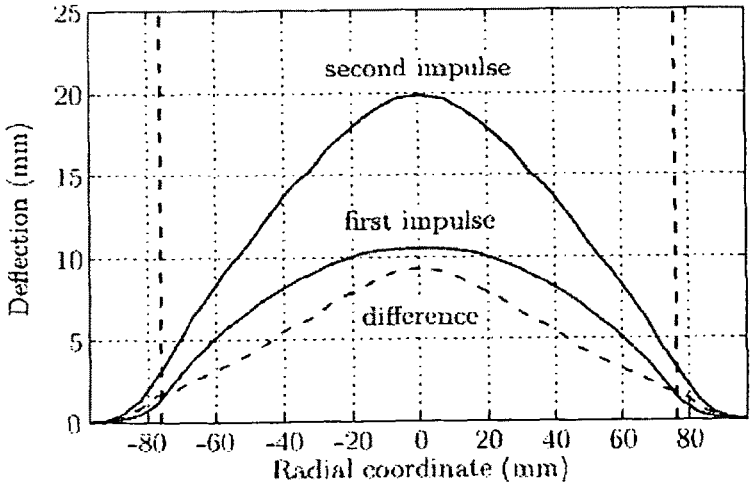
FIG. 5*c* shows the combined effect of the impulses, with the calculated difference in impulses.

FIGS. 5*a*, 5*b*, and 5*c* show the results of the FSI simulation for alloy BA120 showing successive impulse load absorption and high deflection to impulse absorption leading to extreme blast protection applicability for BA 120.

3-D LEAP (Atom Probe) Tomography of alloy BA120 specimens confirmed good compositional accuracy of the austenite matrix and gamma prime phase with those predicted using Thermo-Calc for the γ-γ' phase equilibrium after aging. The measured average precipitate speroidal particle diameter of 15 nm matches well with the optimum gamma prime precipitate size for peak hardness. The predicted number density of γ' also was verified using the envelope method of cluster separation for precipitates.

The Curie temperature $T_c$ was calculated for alloy BA120 as being 102.14K compared to 48.39K for A286 steel and 131.42K for comparison experimental alloy EX425. The Curie temperature for alloy BA120 is well below the limit of 300K (room temperature) such that the behavior would be paramagnetic at use temperatures.

The properties demonstrated for alloy BA120 are an improvement over HSLA 100 alloy steel and comparison experimental alloy EX425 in terms of uniform ductility under tension as well as shear with a high strain hardening at room temperature.

Applications of the austenitic TRIP steel in accordance with the invention include, but are not limited to, naval hull steels with high underwater impulse resistance, vehicle body of military and civilian heavy duty vehicles such as armored trucks and Hummer vehicles, bomb-proof trash can receptacles, safe room doors, walls and floors, and airplane cargo bay enclosures.

Although the invention has been described with respect to certain illustrative embodiments for purposes of illustration, those skilled in the art will appreciate that the invention is not limited thereto and that changes and modifications can be made thereto within the scope of the appended claims.

REFERENCES

1. V. F Zackay, E. R Parker, D. Fahr, and R. Busch: Trans. ASM, 1967, vol. 60, pp. 252-59
2. Stavehaug, F., "*Transformation toughening of γ'-strengthened metastable austenitic Steels*". Doctoral Thesis, 1990, MIT
3. G. B. Olson and M. Cohen, "*Stress-Assisted Isothermal martensitic transformation: Application to TRIP steels", Met. Trans.,* 1982, vol. 13A, pp. 1907-14
4. G. B. Olson and M. Cohen, "*A General Mechanism of Martensitic Nucleation: Part II FCC→BCC and other Martensitic Transformations", Met Trans.,* 1976, vol. 7A p. 1905
5. G. B. Olson and M. Cohen, "*Martensitic Transformation as a Deformation Process*", MIT, 1982
6. Kohn, G., "*Effects of TRIP phenomenon on the toughness of Heat Treatable Alloy Steels*". Doctoral Thesis, University of California, Berkeley, 1976
7. D. Bhandarkar, V. F. Zackay and E. R. Parker, *Metall. Trans.* 3 (1972), pp. 2619-2631
8. Saha, Arup. "*Systems Design of Ultra-tough High Strength Steels for blast-Resistant Naval Hull Application*". Doctoral Thesis, 2004, Northwestern University
9. McCarren M, Chardon M, Chuu K, Forbes T, Fruth S, Haro E, Kuou D, Lee C. *BlasTruss: Civil Shield Technologies*. IDEA 398, March 2004, Northwestern University
10. B. Sundman, B. Jansson, J. O. Andersson, "*The Thermo-Calc databank System", CALPHAD* 9 (1985) 153-190
11. C. S. Smith, "*A search for Structure",* 1988, MIT
12. G. B. Olson, "*Computational Design of Hierarchically Structured Materials", Science* 277 (1997) 1237-1242
13. M. F. Ashby, *Materials Selection in Mechanical Design*, Pergamon, Tarrytown, N.Y., 1992
14. G. B. Olson, "*Designing a New Material World", Science* 288 (2000) 993-998
15. G. B. Olson and M. Cohen: *Met Trans. A*, vol. 7A, 1976, pp 1915
16. K. C. Hsieh, "*Fracture Toughness of Ti-modified Air-melted UHS Steels*", Doctoral Thesis Proposal, Department of Materials Science and Engineering, Northwestern University, Evanston Ill. (2000)
17. D. Raynor, J. M. Silcock, Met. Sci. J. 4 (1970) 121-130
18. S. Asgari, "*Structure and strain hardening of Superalloy AEREX* 350", Journal of Materials Processing Technology 118 (2001) 246-250
19. N. S. Stoloff, in: C. T. Sims, W. C. Hagel (Eds.), *The Superalloys*, Wiley, New York 1972, p. 361
20. Silcock, J. M. and Williams, N. T. "*Precipitation during aging at* 700° *C. of a commercial Austenitic steel containing titanium and aluminum", Journal of the Iron and Steel Institute.* 1966. November: pp. 1100-1107
21. L. M. Brown, R. K. Ham, *Strengthening Methods in Crystals*, Elsevier, Amsterdam, 1971, pp. 9-135
22. R. K. Ham, Ordered Alloys: *Structural Applications and Physical Metallurgy,* Claitors, Baton rouge, La., 1970, pp. 365-373
23. Richman, R. H. and Bolling, G. F, "*Stress, Deformation and Martensitic Transformation", Met. Trans.* 2 (1971) September, 2451
24. G. B. Olson and M. Cohen, J. *Less-Common metals,* 1972, vol. 28, pp. 107-18
25. R. H. Leal: "*Transformation Toughening of Meta-stable Austenitic steels*," PhD Thesis, MIT, 1984
26. C. C. Young: "*Transformation Toughening in Phospho-Carbide Strengthened Austenitic Steels,*" PhD Thesis, MIT, 1988
27. G. B. Olson, "*Transformation Plasticity and the Stability of Plastic Flow*", in *Deformation Processing and Structure*, pp. 391-424, ASM, Metals Park, Ohio, 1983
28. T. Narutani, G. B. Olson and M. Cohen. *J. de. Physique* 43 (1982) C4-429-434
29. R. H. Leal: "*Transformation Toughening of Meta-stable Austenitic steels,*" PhD Thesis, MIT, 1984
30. G. B. Olson and M. Cohen "*Kinetics of strain-Induced martensitic Nucleation", Met. Trans*. A, 1975 vol. 6A, pp. 791
31. G. N. Haidemenopoulos: "*Dispersed-phase Transformation Toughening in Ultra-High Strength Steels,*" PhD Thesis, MIT, 1988
32. F. Latourte, *Ongoing Research*, Northwestern University, 2008
33. K. Ishida and T. Nishizawa, Trans. *Japan Inst., Metals* 15, 217 (1974)
34. R. J. Arsenault and S. Li, *Metall. Trans.* 20A, 1429 (1989)
35. U. F. Kocks, A. S. Argon and M. F. Ashby, in *Thermodynamics and Kinetics of Slip, Progress in Materials Science*, Vol. 19. (1975)
36. G. B. Olson, k. Tzusaki and M. Cohen, in *Turnball Symposium.: Phase transitions in Condensed Systems*, p. 129, Materials Research Society, PA (1987)
37. Y. Liu, K. Ullakko, V. Gavriljuk, V. Nadutov and J. Pietikainen, *Proc. ICOMAT*-89 (edited by B. C. Muddle), p. 56. Trans. Tech. Publication, Zurich 1990
38. G. Ghosh, G. B. Olson, "*Kinetics of FCC→BCC Heterogeneous Martensitic Nucleation-I. The Critical Driving Force for Athermal Nucleation", Acta Mater.* 42 (1994) 3361-3370
39. G. Ghosh, G. B. Olson, "*Kinetics of FCC→BCC Heterogeneous Martensitic Nucleation-II. Thermal Activation", Acta Mater.* 42 (1994) 3371-3379
40. G. L. Krasko and G. B. Olson, "*Effect of Boron, Carbon, Phosphorus and Sulfur on Intergranular Corrosion in Iron*", U.S. Army Materials Technology Lab, MTL, Solid State Communications, Vol. 76. No. 3, pp. 247-251, 1990
41. Echt J, Edelman L, McCarren M, Stempel K, Tu W, M. Bender, "*Civil Shield: Materials and Structures for Anti-Terrorism Blast Protection*", TMS 2004
42. H. J. Jou, L. Li, C. J. Kuehmann, G. B. Olson, "*User Guide for CMD™ (Computational Materials Dynamics) Software*", Version Mar.31, 2003, Questek Innovations LLC, Evanston, Ill. (2003)
43. H. J. Jou, "*Application of Computational Materials Design Tools*", Questek Innovations LLC, Evanston, Ill. (2003)

The above-listed references are incorporated herein by reference.

The invention claimed is:

1. An austenitic TRIP steel consisting essentially of, in weight %, 0.14 to 0.18% Al, 2.8 to 3.2% Ti, 23.5 to 23.8% Ni, 3.8 to 4.2% Cr, 1.1 to 1.3% Mo, 0.29 to 0.31% V, 0.01 to 0.015% B. 0.01 to 0.02% C, and balance Fe and incidental impurities and which is aged to have an austenitic matrix and gamma prime precipitates in the austenitic matrix and a uniaxial tension $M_s^{\circ}$ temperature in the range of about 5 degrees C. to 40 degrees C. after aging to provide improved room temperature ductility in tension and shear including under high strain-rate adiabatic conditions.

2. The steel of claim 1 wherein Mn is optionally present at 0.1% maximum, Si is optionally present at 0.1% maximum, Cu is optionally present at 0.01% maximum, P is optionally present at 0.01% maximum, and S is optionally present at 0.004% maximum where % is weight % of the steel composition.

3. The steel of claim 1 which is free of intentional Mn.

4. The steel of claim 1 having a nominal composition, in weight %, of about 0.16% Al, about 3.0% Ti, about 23.5% Ni, about 4% Cr, about 1.2% Mo, about 0.3% V, about 0.0125% B, about 0.010% C and.balance Fe.

5. A blast resistant structure comprising the steel of claim 1.

6. The structure of claim 5 which is a naval hull, a military or civilian vehicle body, a trash can receptacle, a safe room door, wall or floor, and an airplane cargo bay enclosure.

7. An austenitic TRIP steel consisting essentially of. in weight %, 0.14 to 0.18% Al, 2.8 to 3.2% Ti, 23.5 to 23.8% Ni. 3.8 to 4.2% Cr, 1.1 to 1.3% Mo, 0.29 to 0.31% V, 0.01 to 0.015% B, 0.01 to 0.02% C, and balance Fe and incidental impurities and which is aged to have an austenitic matrix and gamma prime precipitates in the austenitic matrix.

8. The steel of claim 7 having a nominal composition, in weight %, of about 0.16% Al, about 3.0% Ti, about 23.5% Ni, about 4% Cr, about 1.2% Mo, about 0.3% V, about 0.0125% B, about 0.010% C and balance Fe.

9. A blast resistant structure comprising the steel of claim 7.

10. The structure of claim 7 which is a naval hull, a military or civilian vehicle body, a trash can receptacle, a safe room door, wall or floor, and an airplane cargo bay enclosure.

* * * * *

UNITED STATES PATENT AND TRADEMARK OFFICE

CERTIFICATE OF CORRECTION

PATENT NO. : 8,092,620 B2
APPLICATION NO. : 12/460508
DATED : January 10, 2012
INVENTOR(S) : Padmanava Sadhukhan et al.

It is certified that error appears in the above-identified patent and that said Letters Patent is hereby corrected as shown below:

Column 9, Claim 4, line 8; delete "." between "and" and "balance".

Column 9, Claim 7, line 13; replace "." with ",".

Column 9, Claim 7, line 14; replace "." with "," after the word "Ni".

Signed and Sealed this
Twenty-eighth Day of February, 2012

David J. Kappos

David J. Kappos
*Director of the United States Patent and Trademark Office*